United States Patent [19]

Tenser et al.

[11] Patent Number: 5,038,946

[45] Date of Patent: Aug. 13, 1991

[54] PACKAGING AND DISPLAY ASSEMBLY

[76] Inventors: Adrian J. Tenser, 35 Scenic Millway, Willowdale, Ontario, Canada, M2L 1S6; Gordon H. Veres, 123 Carrying Place Trail, R.R. #1, Kettleby, Ont., Canada, L0G 1J0

[21] Appl. No.: 403,118

[22] Filed: Sep. 5, 1989

[51] Int. Cl.[5] ..... A47F 5/00

[52] U.S. Cl. ..... 211/168; 211/96; 211/163; 211/59.1; 206/554

[58] Field of Search ..... 211/168, 96, 59.1, 47.1, 211/163; 206/554, 495, 493, 491

[56] References Cited

U.S. PATENT DOCUMENTS

| | | | |
|---|---|---|---|
| 2,162,919 | 6/1939 | McAuliffe et al. | 211/96 |
| 2,165,654 | 7/1939 | Rosenthal | 211/96 X |
| 2,210,120 | 8/1940 | Gladstone et al. | 211/96 |
| 2,743,023 | 4/1956 | Larson | 211/96 |
| 2,997,167 | 8/1961 | Westfall | 206/554 X |
| 3,318,444 | 5/1967 | Weicher et al. | 206/493 |
| 3,333,690 | 8/1967 | Marsh | 206/554 |
| 4,057,147 | 11/1977 | Fleischmann | 211/96 X |

FOREIGN PATENT DOCUMENTS

| | | | |
|---|---|---|---|
| 2019457 | 12/1978 | Fed. Rep. of Germany | 211/168 |

*Primary Examiner*—Robert W. Gibson, Jr.

*Attorney, Agent, or Firm*—Hodgson Russ Andrews Woods & Goodyear

[57] ABSTRACT

A novel packaging assembly for displaying artistic gift bags and banners, as well as a novel display assembly wherein these banners and bags may be artistically displayed in their packaging. The bags or banners (16) are stacked in register, and the stack (16) is enclosed in a cardboard package which is provided with a gap in the header. The display assembly includes a plurality of racks (50) which may be mounted for swinging movement on a mounting plate assembly (52), each rack including two arms (60, 62) one of which may be slipped through the gap in the header to support the packaging. The mounting plate assembly may be supported on a pegboard (46) or slotwall (54). Alternatively it may be mounted on a novel floor stand (56) or other wire store displays comnmercially available to receive slotwall fixtures.

19 Claims, 3 Drawing Sheets

12
2
16
24
50
52
56
58
60
60a
60b
60c
62
62a
62b
62c
68
72
74
75
76
78
80
82
86
88
90
92
94
96
98

Fig. 4.
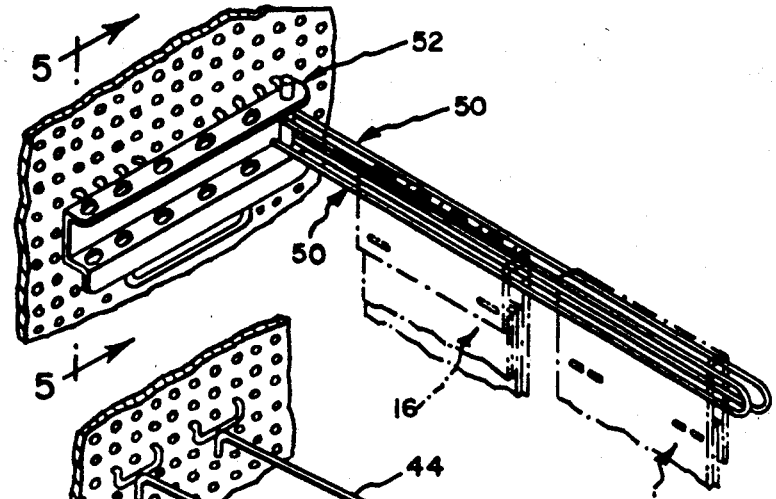
Fig. 6.
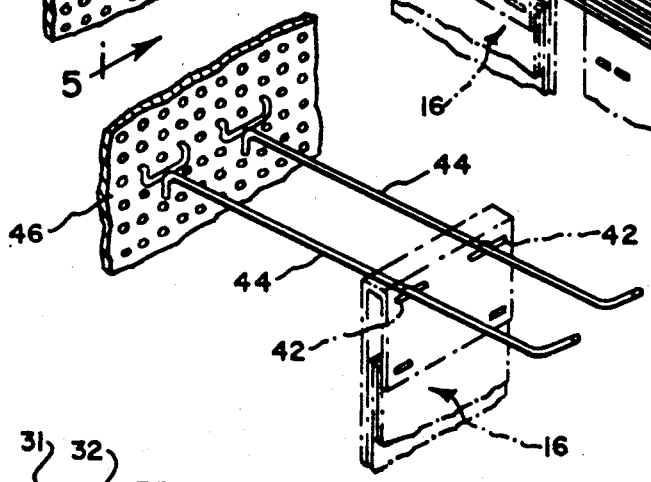
Fig. 7.
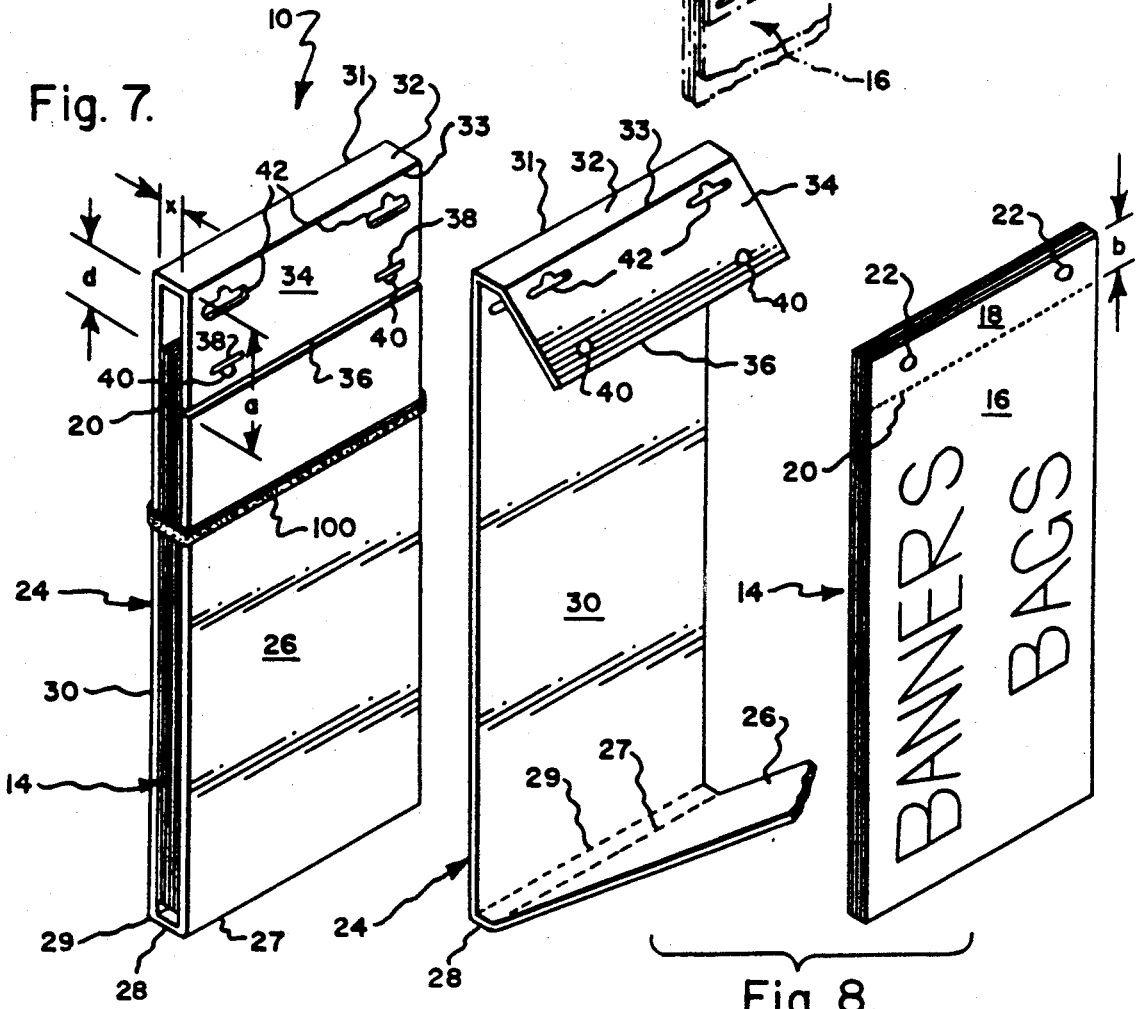
Fig. 8.

PACKAGING AND DISPLAY ASSEMBLY

TECHNICAL FIELD

A packaging and display assembly including both a novel package assembly and a novel display.

BACKGROUND OF THE INVENTION

Packages for bags, banners, and the like are well known in the art and typical examples are shown in U.S. Pat. Nos. 3,333,690, 3,341,003, and, more recently, 4,557,384. While these packages have been suitable for their intended purposes, no effort has been made to integrate the design of the package with its support rack or display assembly. Thus, the above are only adapted to be mounted upon a hook or hooks which extend transversely through the top portion of the packaging. While these designs may be acceptable when selling bags without artistic content on the face of the bags, recently a variety of gift bags and banners have been developed which include a large variety of different styles and it is necessary to provide adequate display assemblies for displaying a wide variety of bags.

OBJECTS IN SUMMARY OF THE INVENTION

Accordingly, it is an object of the present invention to provide a novel display assembly and packaging wherein a large variety of package assemblies may be simultaneously displayed from a single display assembly.

It is an additional object of the present invention to provide a novel packaging assembly which can be easily mounted upon horizontally extending racks in side-by-side position, which packaging assembly further facilitates the tearing of individual bags from the assembly.

It is another object of the present invention to provide a novel mounting for supporting a plurality of racks upon which one or more packaging assemblies can be mounted, the mounting in turn being capable of being supported by pegboards, slotwalls, or specially designed floor stands.

The above objects and other objects and advantages of this invention will become more apparent after a consideration of the following detailed description taken in conjunction with the accompanying drawings in which preferred form of this invention is illustrated.

DESCRIPTION OF THE FIGURES

FIG. 4 is a view similar to FIG. 3 but showing a display fixture mounted upon a pegboard.

FIG. 6 illustrates an alternate manner in which the packaging assembly of this invention may be mounted.

FIG. 7 illustrates a complete packaging assembly ready for shipping.

FIG. 8 is an exploded view of the assembly shown in FIG. 7, with the principal parts being shown in a partially disassembled position.

DETAILED DESCRIPTION

Figures 1, 1A, 1B, 1C:
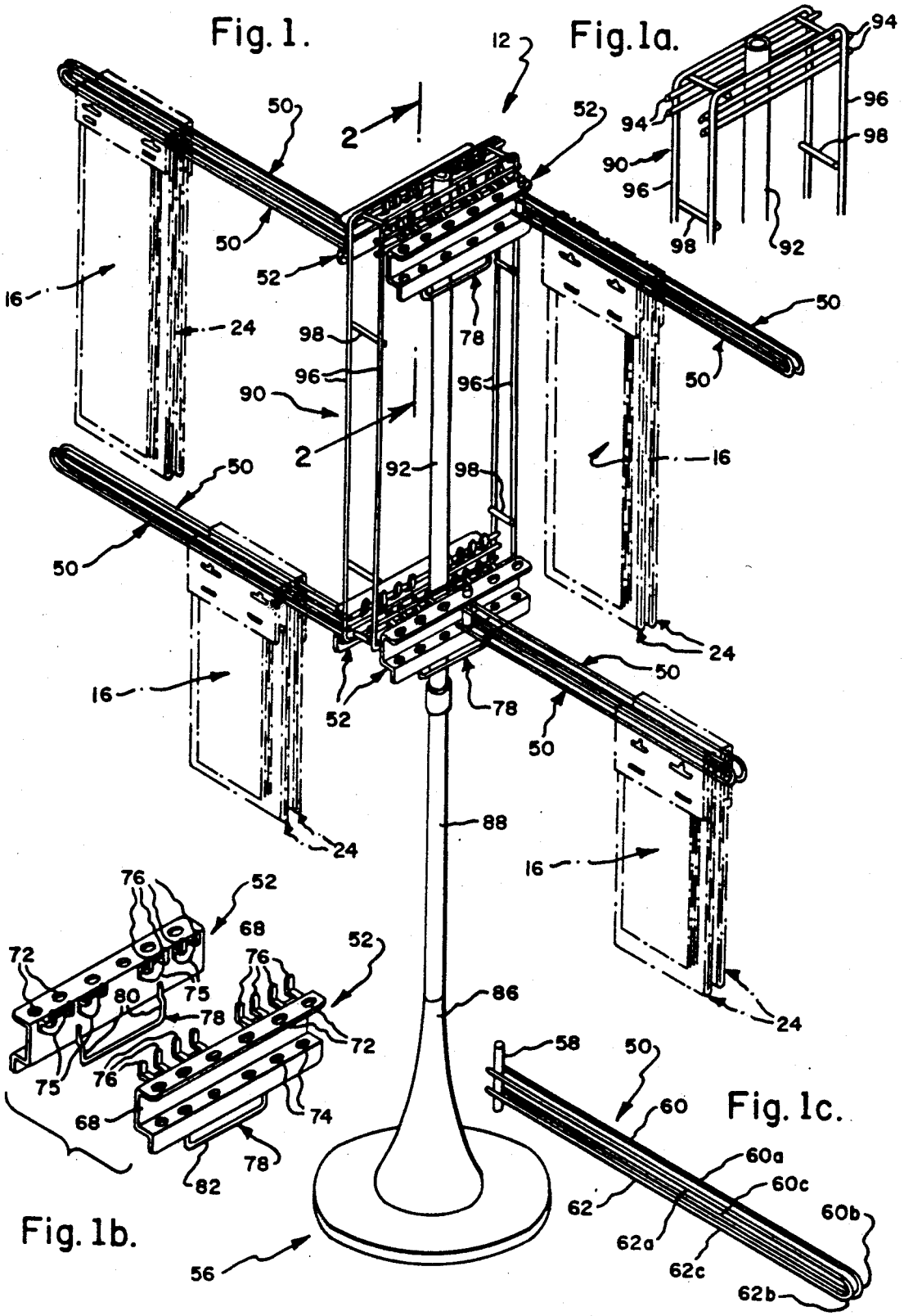
FIG. 1 is an isometric view of a novel floor stand carrying upper and lower pairs of display fixtures in back-to-back relationship, the packaging assemblies of this invention being indicated by phantom lines.
FIG. 1*a* is an upper detail of the floor stand shown in FIG. 1 but without the upper pair of back-to-back display fixtures.
FIG. 1*b*. illustrates a portion of a pair of back-to-back display fixtures, the mounting plate assembly of the fixtures being illustrated.
FIG. 1*c* illustrates a rack capable of being utilized by one of the mounting plate assemblies illustrated in FIG. 1*b*.

The present invention includes two principal components, these being the packaging (or packaging assemblies) indicated generally at 10 in FIG. 7 and the display assembly indicated generally at 12 in FIG. 1. The display assembly includes a plurality of support arms, which will be described below, each support arm typically being capable of receiving two or more of the packaging assemblies shown in FIG. 7. This can be seen from FIGS. 1, 3, and 4. As the display assembly is designed to receive the specific packaging shown in FIGS. 7 and 8, the packaging will be initially described in detail.

PACKAGING ASSEMBLY

As previously indicated above, it is the aim of this invention to provide both a novel packaging assembly for displaying artistic gift bags and banners, as well as a novel display assembly wherein these banners and bags may be artistically displayed in their packaging. Accordingly, the packaging has been developed which facilitates the shipping of the bags or banners, and which also facilitates the display of bags or banners with a printed side being fully exposed. The bags or banners are disposed in register so that a large number may be supported in a relatively compact space. In this connection, it should be noted that the banners and bags which are to be displayed are preferably made from a relatively thin film plastic material, and thus a large number may be stacked one on top of another in register.

Whether the product displayed is a bag or a banner, it will be formed of generally rectangular sheets, indicated generally at 14 (FIG. 8), each of the sheets including a main body portion 16 and a mounting portion 18. The main body portion and the mounting portion are separated from each other by a perforated tear line 20. The mounting portion is preferably provided with spaced apart register holes 22 to facilitate assembling a plurality of sheets one on top of another in register with each other. In this connection, when assembling a stack of bags or banners it should be noted that the sheets will all have the same rectangular dimensions for each stack.

Once a plurality of substantially identically shaped paper-like sheets have been stacked in register into a pile, the pile of sheets is then mounted within a cardboard package, the package being indicated generally at 24. The cardboard package is preferably formed from a single sheet of cardboard or corrugated board. The sheet includes a number of panels which are separated from each other by bend lines, which are preferably formed by perforating the cardboard. Thus, the package includes a lower front portion 26, a bottom portion 28, a backing portion 30, a top portion 32, and an upper front portion 34. The lower front portion is interconnected with the bottom portion along bend line 27. The bottom and backing portions are interconnected with each other along bend line 29. The top and backing portions are interconnected with each other along bend line 31. Finally, the top and upper front portions are interconnected with each other along bend line 33. The lower edge 36 of the upper front portion 34 may serve the function of acting as a tearing edge. Thus, when the plurality of sheets in register are mounted within the package, the tear line or lines 20 will be placed in substantial register with the bottom edge 36 of the upper front portion. In this connection, the parts are held together by fasteners 38, which in the preferred embodiment are staples, the staples passing through the upper front portion 34, the mounting portion 18, and an upper part of the backing portion 30, the assembled construction being best illustrated in FIG. 7. In order to facilitate assembly, the backing portion as well as the upper front portion 34 may be provided with further register holes 40 to facilitate the alignment of the stack of bags or banners within the packaging. In addition, the staples 38 may be placed directly over the holes 22 and 40 in order to ensure that the staples pass through the mounting portion 18 of each of the bags.

Figure 2:
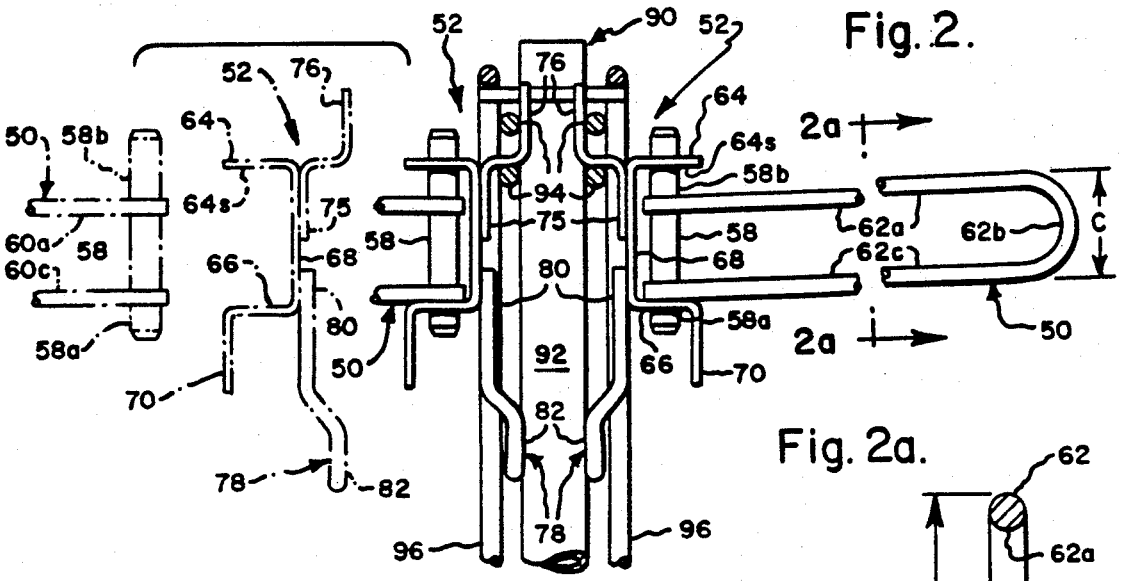
FIG. 2 is a section taken generally along the line 2—2 in FIG. 1.
Figure 2A:
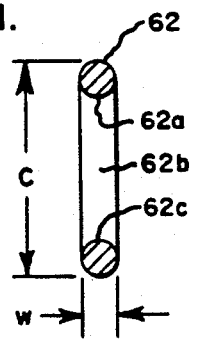
FIG. 2*a* is a section taken generally along the line 2*a*—2*a* in FIG. 2.

It is a feature of this invention that the header of the package, that is to say that portion of the cardboard package disposed about and above the mounting portions 18, is provided with a gap, the gap best being illustrated in FIG. 7. Thus, the interior height "a" of the upper front portion 34 greater than the height of "b" of the mounting portion 18 by an amount equal to or greater than the vertical height "c" of an arm (FIG. 2*a*) which will be used to support the packaging. Thus, an arm may be extended between the upper front portion and the backing portion with the top edge of the arm lying against the bottom surface of the top portion 32 to support the entire packaging. The construction of the arm and its relationship to the packaging will be more clearly brought out below. Finally, it should be noted that the packaging is additonally provided with aligned hanger holes 42, which laterally spaced apart hanger holes may be utilized to support the packaging upon hooks 44 which may extend outwardly of a pegboard or slotwall 46. While such hooks 44 (which are of a conventional design) may be utilized for mounting the packaging of this inventions, it is not the preferred form, the preferred form being discussed below.

DISPLAY ASSEMBLY

The display assembly 12 includes, as its principal components, a plurality of racks indicated generally at 50, one being show in FIG. 1*c*, mounting plate assemblies indicated generally at 52, two being shown in FIG. 1*b*, and a support for the mounting plate assembly. The support can be in a variety of forms, such as for example a pegboard 46, best shown in FIG. 4, a slotwall assembly indicated generally at 54 in FIG. 3, or a floor stand indicated generally at 56 in FIG. 1. The slotwall may be provided with an insert 57, which may be either a plastic or aluminum extrusion.

Each of the racks 50 include a vertically extending post 58 and a pair of outwardly extending laterally spaced apart parallel support arms 60, 62 secured to opposite sides of the post 58. Each of the arms for each of the racks is formed from a single length of wire which is shaped into a generally U-shaped configuration with the bight 60*b* or 62*b*, being disposed away from the post 58. Each of the bights is an extension of an upper wire and a lower wire. Thus, the arm 60 has an upper wire 60*a* and a lower wire 60*c*, the outer ends of the two wires being interconnected by the bight 60*b*. Similarly arm 62 has an upper wire 62*a* and a lower wire 62*c*, these wires being interconnected by the bight 62*b*. The inner end of each of the upper and lower wires is secured, as by welding or the like, to a side of the post 58. Thus, as can be seen from the various figures the inner ends of upper and lower arms are welded to the post 58. Since the arms 60, 62 may deflect slightly downwardly when supporting the packaging of this invention, the arms may be welded to the posts in such a manner that they extend slightly upwardly, best shown in FIGS. 2 and 5. The distance of the gap "d" within the header (FIG. 7) is equal to or greater than the distance "c" between the top surface of the upper arm and the lower surface of the lower arm so that the arm may be slid into the header. However, the width × (FIG. 7) of the gap in the header card is less than the width w of the arms 60, 62 so that the top portions of the packaging will snugly engage the associated support arm to hold the packaging from sliding on the arm.

Figure 3:
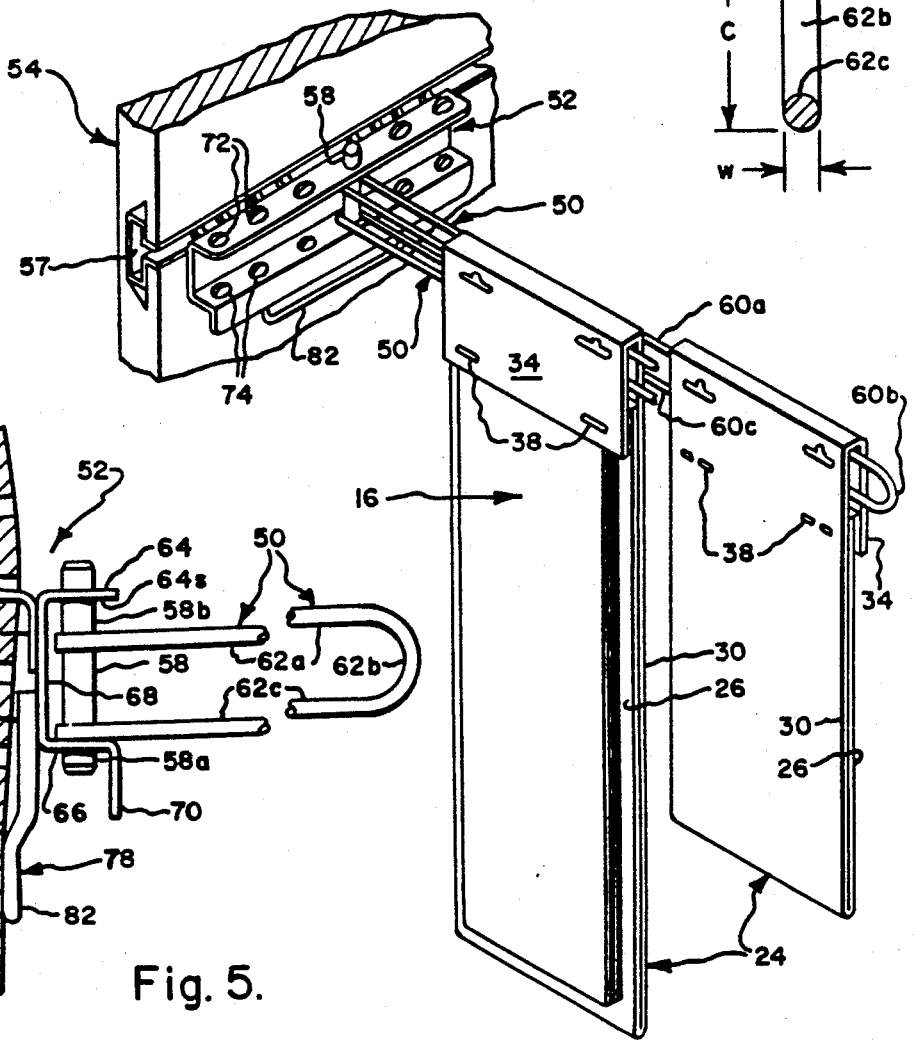
FIG. 3 shows a single display fixture of the type illustrated in FIG. 1, the display fixture being mounted upon a slotwall.
Figure 5:
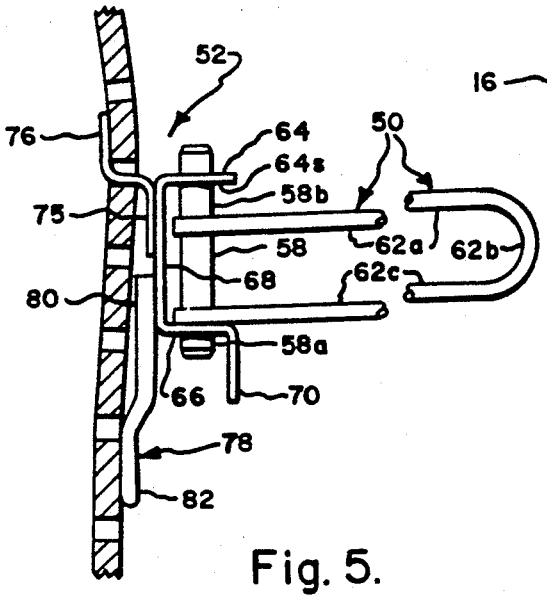
FIG. 5 is a section taken generally along the line 5—5 in FIG. 4.

The mounting plate assembly 52 includes spaced apart parallel upper and lower plates 64, 66, respectively, (FIG. 5) which plates are interconnected by an intermediate vertically extending plate 68. The plates 64, 66 and 68 are formed from a single piece of sheet metal, the sheet metal plate further including a downwardly extending vertical plate or lip 70 which extends downwardly from an edge of the lower plate 66. Each of the upper and lower plates are provided with a plurality of spaced apart apertures, the upper plate apertures 72 being in alignment with the lower plate aperture 74. As can best be seen from FIGS. 2 and 5, the post 58 is of sufficient length that it may extend through aligned apertures 72, 74. In addition, the length of the lower most portion of the post 58*a*, that is to say that portion of the post which extends below the lower surface of the lower wire 60*c* or 62*c* is of a shorter length than that section of the post 58*b* which is disposed between the upper surface of the associated upper wire 60*a* or 62*a* and the lower surface 64*s* of the upper plate 64 when the parts are assembled as shown in FIG. 5. Therefore, it is possible to shift a rack upwardly until the lowermost end of the lower past portion 58*a* has cleared the top surface, of the lower plate 66, as the uppermost surface of the upper arms have not yet contacted the bottom surface 64*s* of the upper plate 64. This permits easy installation and removal of racks from the mounting plate assembly. The construction illustrated also provides for easy swinging movement of the racks between a normal position, as shown in FIG. 3, to extreme right and left-hand swinging positions (not shown). This permits a plurality of racks 50 to be disposed upon a single mounting plate assembly 52, for example 6, and yet will permit customers to swing the racks so that they can better view the articles mounted in the packaging.

Each of the mounting plate assemblies has four sheet metal mounts 75 welded to the upper back surface of the vertical plate 68, each of the mounts being provided with a pair of upwardly extending hook-like mounting means 76, the hook-like mounting means being of the type adapted to be received by a pegboard. In addition, a U-shaped member (indicated generally at 78) is provided, the member having a pair of upwardly extending legs 80 which are welded of their upper ends to a lower back surface of the plate 68. The bight portion 82 is offset as can be seen from the drawings. The purpose of the offset bight is to provide greater stability for the racks and mounting plate assemblies, particularly when mounted on pegboards. Thus, when the mounting plate and racks assemblies are mounted on a pegboard and fully loaded with display packages, the pegboard will be caused to be distorted to the position illustrated in FIG. 5 due to the weight applied by the packaging and display assembly. In addition, the offset bight portion is also adapted to bear against a portion of a floor stand 56 as will be brought out below in order to provide for proper mounting. As can be seen from FIG. 3, the hook-like mounting means 76 may be received within slots of a slotwall with the bight portion bearing against a lower portion of the slotwall to provide a good mounting surface.

The floor stand 56 is formed of three principal elements, these being a base 86 which may be of a trumpet shape, an intermediate tube 88, and a tube-and-frame assembly indicated generally at 90. The base 86, intermediate tube 88, and tube-and-frame assembly 90 are provided with suitable mating portions so that the parts can be telescopically assembled in the manner indicated. The tube-and-frame assembly 90, as can be seen from FIG. 1, is capable of supporting an upper pair and a lower pair of mounting plate assemblies 52 in back-to-back relationship. To this end, the tube-and-frame assembly includes a centrally located tube 92 and upper and lower opposed mounting means, each of the upper and lower mounting means including two pair of parallel transversely extending wires 94 which have intermediate portions welded to the tube. Stop means are provided at the end of the wires, the stop means being in the form of a generally rectangularly shaped wire 96 which engages the ends of the upper and lower parallel wires 94. Finally, the rectangularly shaped wires are interconnected to each other by transversely extending wires 98. When the mounting plate assemblies 52 are mounted upon the tube-and-frame assemblies 90, the plates 64 through 70 will lie between the vertical portions of the rectangular wire 96 with the bight portion 82 of the U-shaped member bearing against the tube 92.

When practicing this invention, the packaging is assembled as illustrated in FIG. 7 with a rubber band 100 holding the parts together in their closed position. When it is desired to mount the packaging onto a display, it is only necessary to remove the rubber band 100 and either mount the packaging as shown in FIG. 6 onto the hooks 44 or to slide an arm 60 or 62 through the gap within the header. When this is done, the lower front portion 26 of the packaging will be ripped off at the bend line 27 or 29 and discarded. Alternatively, the lower front portion 26 may be folded in the same position as when closed, but behind the main body of portion 16 of suspended sheets 14 with the face of the portion 26 in the same direction as when closed, as best shown in FIG. 3.

It can be seen that the floor stand of the invention may be readily assembled and that by utilizing the mounting plate assemblies of this inventions that up to 24 racks may be provided, each rack being so dimensioned that it may receive four packages, thus, providing a means whereby up to 96 packages may be displayed. While many shops may not require this quantity, it should also be appreciated that a single mounting plate assembly when mounted on a slot board or pegboard, is capable of supporting 6 racks, each rack being able to support up to 4 packages of bags or banners whereby 24 packages of bags or banners can be displayed on a single mounting plate assembly. Therefore, by utilizing the principles of the present invention the aims of this invention of providing a proper display for novel packaging has been accomplished.

While a preferred embodiment of this invention has been described in detail above, it should be appreciated that other embodiments of this invention will be apparent to those having ordinary skill in the art. Therefore, it is to be understood that the invention is not to be limited to the particular details shown or described above, but that, in fact, widely differing means may be employed in the practice of the broader aspects of this invention.

What is claimed is:

1. A packaging assembly for use with a display assembly of the type including an outwardly extending support arm; said packaging assembly comprising:

a plurality of substantially identically shaped paper- or film-like sheets stacked in register, the sheets being usable as gift bags, banners, or the like, each sheet including a main body portion and a mounting portion, the main body portion and mounting portion being integral with each other but separated from one another by a perforated tear line, the mounting portion of each of the sheets being provided with laterally spaced apart register holes to facilitate stacking a plurality of sheets in register with one another;

a header portion disposed to either side of the mounting portions of the sheets, there being a gap within the header portion above the top of the mounting portions for the receipt of a support; and fastener means passing through the mounting portion and header portion of the plurality of sheets for securing the parts together.

2. The packaging assembly as set forth claim 1 wherein the combined vertical length of the upper and lower front portions are substantially equal to the vertical length of the backing portion so that when the parts are assembled together for shipping the lower front portion may be placed in juxtaposed relationship with the upper front.

3. A display fixture comprising:

a mounting plate assembly including spaced apart upper and lower horizontally extending parallel plates, each plate being provided with a plurality of apertures, the apertures in one plate being in alignment with the apertures in the other plate, and hook-like mounting means interconnected with the upper and lower plates; and a plurality of racks removably supported by the mounting plate assembly, each rack including a vertically extending post having opposite end portions received by an aligned pair of apertures in the upper and lower plates, and a pair of outwardly extending laterally spaced apart parallel support arms secured to opposite sides of the post.

4. The display fixture as set forth in claim 3 wherein each of the arms includes an upper wire portion, a lower wire portion, and an outer bight wire portion, the outer end of each of the upper and lower wire portions being interconnected to each other by the bight portions.

5. The display fixture set forth in claim 4 wherein the inner end of each of the upper and lower wire portions is welded to the post.

6. The display fixture as set forth in claim 3 wherein the mounting plate assembly includes an intermediate vertically extending plate, the upper, lower, and intermediate plates all being formed from a single piece of sheet metal.

7. The display fixture as set forth in claim 6 wherein the hook-like mounting means is secured to the intermediate plate.

8. The display fixture as set forth in claim 3 wherein the hook-like mounting means includes laterally spaced apart hooks of the type adapted to be received by a pegboard or slotwall.

9. The display fixture as set forth in claim 3 wherein the hook-like mounting means includes four pairs of hooks.

10. A packaging and display assembly comprising: a display fixture including a mounting plate assembly having spaced apart upper and lower horizontally extending parallel plates, each of the plates being provided with a plurality of apertures, the apertures in one plate being in alignment with the apertures in the other plate, and a plurality of racks removably supported by the mounting plate assembly, each rack including a vertically extend- ing post received by an aligned pair of apertures in the upper and lower plates, and an outwardly extending support arm secured to the post; and one or more packaging assemblies carried by each rack, each packaging assembly including a plurality of substantially identically shaped paper- or film-like sheets stacked in register, the sheets being usable as gift bags, banners, and the like, each sheet including a main body portion and a mounting portion, the main body portion and mounting portion being integral with each other but separated from one another by a perforated tear line, a header portion disposed to either side of the mounting portions of the sheets, there being a gap within the header portion above the top of the mounting portions for the receipt of a support arm, and fastener means passing through the mounting portion and header portion of the plurality of sheets for securing the parts together.

11. The packaging and display assembly as set forth in claim 10 wherein the header portion is part of a cardboard package which includes a lower front portion below the header portion, which lower front portion may be disposed over the sheets during shipping and which may be disposed behind the sheets when the packaging is on display.

12. The packaging and display assembly as set forth in claim 10 wherein the header portion includes an upper front portion having a horizontally extending lower edge, the perforated tear line being maintained in register with the lower edge by the fastener means to facilitate the tearing of the main body portion from the mounting portion.

13. The packaging and display assembly as set forth in claim 10 wherein the mounting plate assembly further includes an intermediate vertically extending plate, the upper, lower and intermediate plates all being formed from a single piece of sheet metal, and wherein hook-like mounting means of the type adapted to be received by a pegboard or slotwall are provided which extend above the vertical plate, and wherein the mounting means further includes a U-shaped wire member, the bight portion being disposed below the intermediate plate member.

14. The packaging and display assembly as set forth in claim 10 further including a support for the mounting plate assembly.

15. The packaging and display assembly as set forth in claim 14 wherein the support is a floor stand.

16. The packaging and display assembly as set forth in claim 15 wherein the floor stand includes a base, an intermediate vertically extending tube supported at its lower end upon the base, and an upper tube-and-frame assembly, the tube-and-frame assembly being capable of supporting upper and lower back-to-back mounting plate assemblies.

17. The packaging and display assembly as set forth in claim 16 wherein the tube-and-frame assembly include an upper vertically extending tube, upper and lower opposed mounting means each including upper and lower horizontally extending wires, stop means at the outer ends of each of the upper and lower wires, and support means of capable of engaging a lower portion of each of the mounting plate assemblies, the support means being disposed below the lowermost wire.

18. The packaging and display assembly as set forth in claim 10 wherein the support arm of each rack is secured to an intermediate portion of the post, the post having opposite end portions received by the aligned pair of apertures.

19. The packaging and display assembly as set forth in claim 10 wherein the support arm of each rack is provided with a pair of out- wardly extending laterally spaced apart support arms which are secured to opposite sides of the post.

* * * * *